US008960710B2

(12) United States Patent
Pascal

(10) Patent No.: US 8,960,710 B2
(45) Date of Patent: Feb. 24, 2015

(54) REAR HOOP FOR A SNOWBOARD BINDING

(75) Inventor: Jean-Marc Pascal, Voreppe (FR)

(73) Assignee: Skis Rossignol, Moirans (FR)

( * ) Notice: Subject to any disclaimer, the term of this patent is extended or adjusted under 35 U.S.C. 154(b) by 1431 days.

(21) Appl. No.: 12/169,765

(22) Filed: Jul. 9, 2008

(65) Prior Publication Data

US 2009/0014984 A1 Jan. 15, 2009

(30) Foreign Application Priority Data

Jul. 10, 2007 (FR) ..... 07 04973

(51) Int. Cl.
*A63C 9/00* (2012.01)
*A63C 10/24* (2012.01)

(52) U.S. Cl.
CPC ..... *A63C 10/24* (2013.01)
USPC ..... 280/611; 280/618; 280/14.24

(58) Field of Classification Search
USPC ..... 280/611, 612, 619, 623, 624, 627, 628, 280/629, 636, 11.36, 14.21, 14.22, 14.24
See application file for complete search history.

(56) References Cited

U.S. PATENT DOCUMENTS

| | | | | |
|---|---|---|---|---|
| 2,176,226 | A * | 10/1939 | Reed, Jr. | 280/621 |
| 2,610,068 | A * | 9/1952 | Majneri | 280/622 |
| 2,822,613 | A * | 2/1958 | Lundberg | 33/3 A |
| 2,987,834 | A * | 6/1961 | Howe | 36/125 |
| 3,825,273 | A * | 7/1974 | Greene | 280/618 |
| 3,861,698 | A * | 1/1975 | Greig | 280/604 |
| 3,944,237 | A * | 3/1976 | Teague, Jr. | 280/618 |
| 4,116,462 | A * | 9/1978 | Buel | 280/614 |
| 4,168,085 | A * | 9/1979 | Faulin | 280/618 |
| 4,251,894 | A * | 2/1981 | Hollingsworth | 441/64 |
| 6,283,495 | B1 | 9/2001 | Phillips | |
| 6,315,318 | B1 * | 11/2001 | Caron et al. | 280/617 |
| 6,412,808 | B1 * | 7/2002 | Chevalier et al. | 280/611 |
| 6,450,526 | B1 * | 9/2002 | Bressand | 280/626 |
| 6,485,035 | B1 * | 11/2002 | Laughlin et al. | 280/14.21 |
| 6,619,533 | B1 * | 9/2003 | Hootman et al. | 228/112.1 |
| 6,648,365 | B1 * | 11/2003 | Laughlin et al. | 280/624 |
| 7,494,148 | B2 * | 2/2009 | Muscatelli | 280/611 |
| 7,520,526 | B2 * | 4/2009 | Muscatelli | 280/617 |
| 7,681,905 | B2 * | 3/2010 | Hauglin | 280/615 |
| 2002/0027335 | A1 * | 3/2002 | Hale | 280/611 |
| 2002/0190503 | A1 * | 12/2002 | Laughlin et al. | 280/623 |
| 2003/0197349 | A1 * | 10/2003 | Laughlin et al. | 280/624 |
| 2007/0187927 | A1 * | 8/2007 | Muscatelli | 280/620 |

FOREIGN PATENT DOCUMENTS

| | | | | |
|---|---|---|---|---|
| EP | 1 149 611 | A | 10/2001 | |
| FR | 2636854 | A1 * | 3/1990 | A63C 5/03 |
| FR | 2641703 | A1 * | 7/1990 | A63C 5/03 |
| FR | 2 758 092 | A | 7/1998 | |
| FR | 2 838 977 | A | 10/2003 | |
| WO | WO 2006/077180 | A | 7/2006 | |
| WO | WO 2007/064890 | A | 6/2007 | |

OTHER PUBLICATIONS

Search Report issued by French Patent Office on Feb. 8, 2008 for French Patent Application 07 04973.

* cited by examiner

*Primary Examiner* — J. Allen Shriver, II
*Assistant Examiner* — Bridget Avery
(74) *Attorney, Agent, or Firm* — Frommer Lawrence & Haug LLP; Ronald R. Santucci

(57) ABSTRACT

A rear hoop (3) for a snowboard boot binding, having an overall shape in the form of a U and comprising a central connecting part (12) arranged between two arms (11) suitable for forming a movable connection with a snowboard boot binding, the hoop (3) comprising at least one zone where it consists of an extruded hollow body.

20 Claims, 2 Drawing Sheets

REAR HOOP FOR A SNOWBOARD BINDING

This application claims priority benefits from French Patent Application No. FR 07 04973 filed Jul. 10, 2007, the disclosure of which is hereby incorporated by reference.

The present invention relates to a rear hoop or "heel cup" for a snowboard boot binding. It also relates to a snowboard boot binding comprising such a hoop and a snowboard comprising such a binding. Finally it also relates to a method for manufacturing such a rear hoop.

A first category of snowboard boot bindings, such as the solution described in the document FR2758092, exists according to the state of the art, said bindings consisting of devices comprising a base and a rear hoop which are inseparable and form a single piece manufactured usually by means of the same plastic injection-molding operation. These solutions have a first drawback consisting in lack of flexibility since the rear hoop is not adjustable, resulting in their use being limited to a certain number of boot sizes. Several different sizes must therefore be manufactured for each model, resulting in the need for several production molds and corresponding high costs. A second drawback of these solutions consists in the fact that the rear hoops have a considerable thickness and therefore comprise a large quantity of plastic material, this being expensive and limiting the possible aesthetic effects.

A second category of snowboard boot bindings, such as the solution described in the document FR2838977, exists according to the state of the art, where the rear hoop is generally made of metal and separate from the rest of the base, being assembled by means of a movable connection with the base so as to allow adjustable positioning in relation to the base so as to be adaptable to the size of a boot positioned within the base. In these solutions, the rear strap for fixing the boot in the region of the heel is generally mounted on the hoop so as to be adapted to the boot whatever the position of the hoop. With such a solution it is thus possible, for example, to retract the hoop in order to receive larger size boots. It is therefore more flexible than the solutions provided by the first category of bindings since a same base is compatible with a larger number of boot sizes. The drawback of these solutions consists in their high cost since they are based on a hoop which is made of thick metal in order to withstand the stresses applied and ensure good rigidity and high strength after folding thereof. The method for manufacturing such a hoop is complex and costly since it comprises the stages of deep-drawing a metal sheet in order to form the hoop, this stage generating a large amount of waste material, followed by assembly with the base. Moreover, the geometry of the hoop is subject to mechanical constraints which require a large thickness, this limiting greatly the definition of varied forms in an attempt to obtain an attractive appearance.

Moreover, in all of the solutions according to the state of the art described above, the fixing systems provided on the rear hoop, for example to fix this hoop to the base or fix a strap or a "highback" onto the hoop, are achieved using aesthetically unattractive screws or mechanical means visible on the outside of the binding.

A general object of the present invention therefore consists in providing an improved snowboard boot binding which is able to overcome at least partially the abovementioned drawbacks.

More precisely, the present invention consists in a solution which attempts to achieve the following objects.

A first object of the present invention is to provide a design of snowboard boot binding suitable for a large number of boot sizes.

A second object of the present invention is to provide a design of snowboard boot binding which is low-cost and easy to manufacture.

A third object of the present invention is to provide a design of snowboard boot binding which has a very attractive aesthetic appearance, better than that of the prior art.

The invention is based on a rear hoop for a snowboard boot binding, having an overall shape in the form of a U and comprising a central connecting part arranged between two arms suitable for forming a movable connection with a snowboard boot binding, the hoop comprising at least one zone where it consists of an extruded hollow body.

The invention also relates to a method for manufacturing a rear hoop for a snowboard boot binding, comprising the following stages:

manufacturing a section comprising a hollow structure by means of extrusion;

cutting and forming the section.

The invention is defined more precisely by the claims.

These objects, characteristic features and advantages of the present invention will be explained in detail in the following description of a particular embodiment illustrated by way of a non-limiting example in connection with the accompanying drawings in which.

Figure 1:
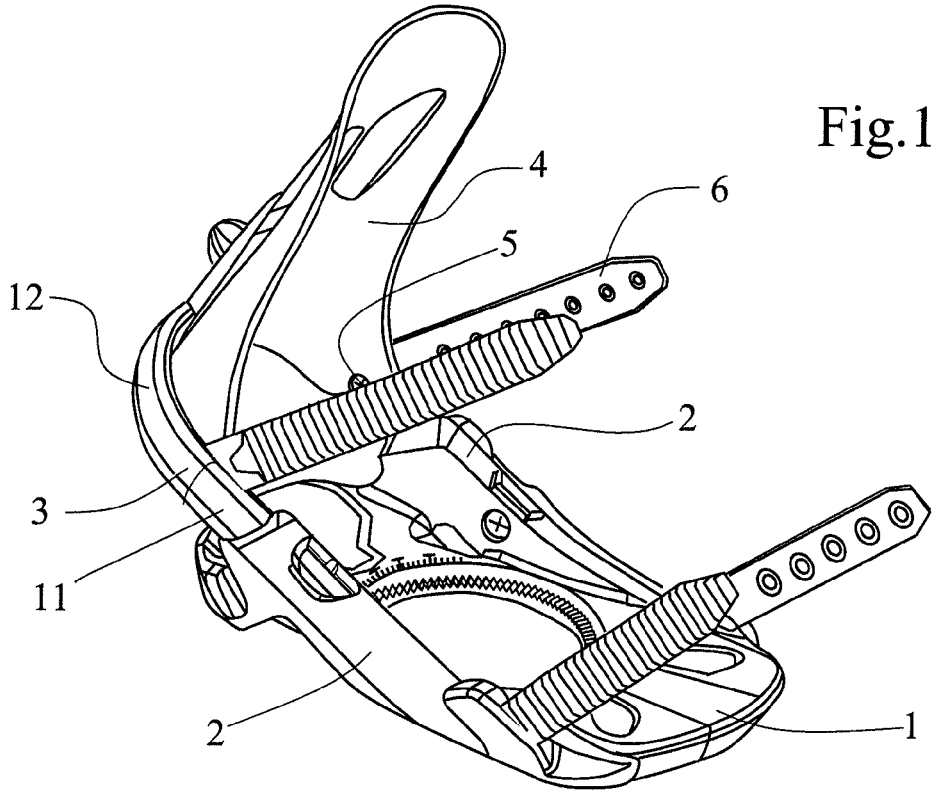
FIG. 1 shows a partial front perspective side view of a snowboard boot binding according to an embodiment of the invention.

FIG. 1 shows a partial view of a snowboard boot binding which comprises a base having a horizontal part 1 intended to receive a boot between vertical side parts 2 which have the function of laterally holding the boot and on which at least the means 6 for fixing the front part of the boot is fixed, in a manner known from the prior art.

The invention relates to the rear part of this binding and in particular to the rear hoop 3 having the overall shape of a U which matches the rear shape of the heel and which acts as a means for holding and supporting the boot at the rear by means of a "highback" or spoiler 4 extending vertically and mounted on this hoop at a fixing point 5, its rear side remaining in contact against the hoop 3. A strap 6 for fixing the boot is mounted on this hoop at the same connection point 5, being rotationally movable about this point so as to be able to be positioned in the best manner on top of the boot opposite the heel. The top part of the straps 6 is not shown in order to facilitate comprehension of the figure.

Figure 2:
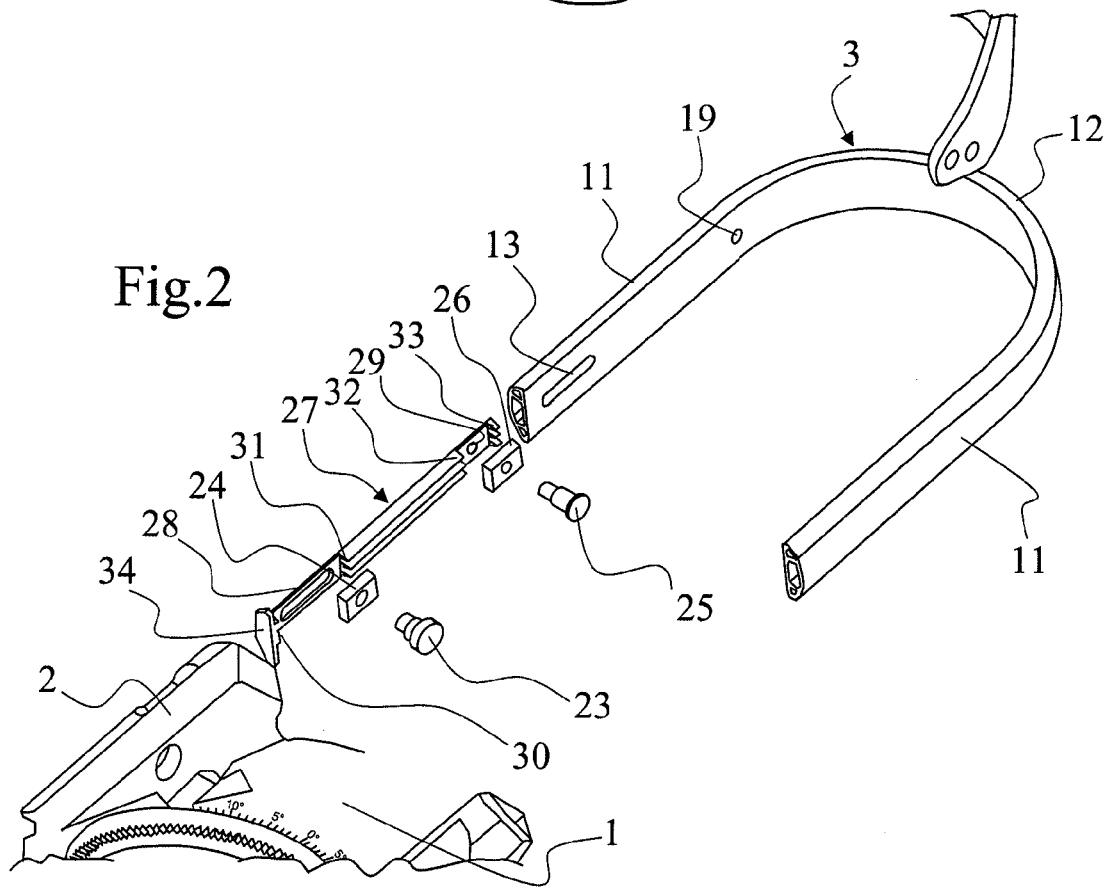
FIG. 2 shows an exploded perspective view of the connection between the rear hoop and the base of the snowboard boot binding according to the embodiment of the invention.
Figure 3:
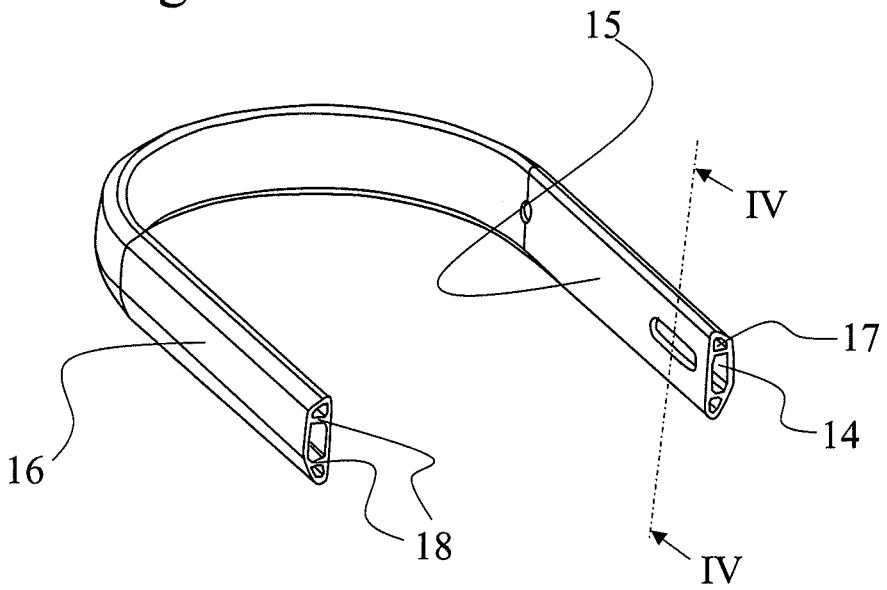
FIG. 3 is a perspective view of the rear hoop according to the embodiment of the invention.
Figure 4:
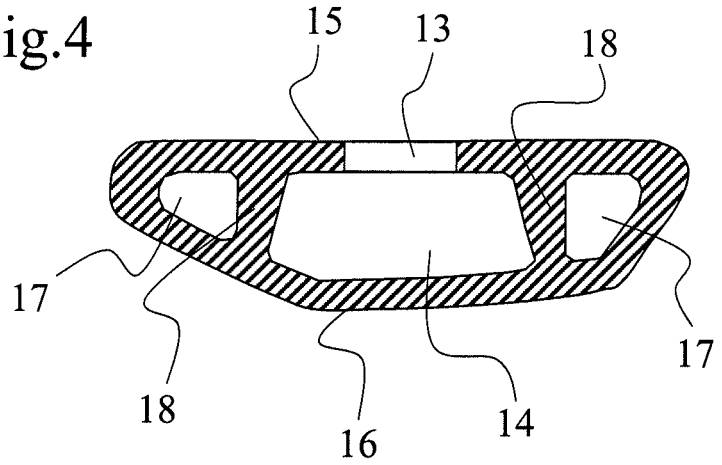
FIG. 4 is a cross-sectional view along the line IV-IV of the rear hoop according to the embodiment of the invention.

The rear hoop 3, which is shown in greater detail in FIGS. 2 to 4, comprises two parallel side arms 11 which are positioned on both sides of the boot and a central rounded connecting part 12 intended to mate with the rear part of the boot just above the heel.

According to an essential feature of the invention, this hoop 3 is separate from the base 1, 2 and connected to the base by its two end parallel arms 11 which co-operate with seats formed in the side parts 2 of the base. By means of a window formed in the upper surface of the side parts it is possible to view the hoop on which there are graduations able to indicate precisely the longitudinal adjustment chosen.

Throughout the text the longitudinal direction will be regarded as that extending from the rear towards the front of the binding, passing substantially from the center of the hoop 3 towards the center of the base 1, and the vertical direction is regarded as the direction perpendicular to the plane defined by the horizontal surface 1 of the base.

According to another essential characteristic feature of the hoop, it has a hollow structure, the cross-section of which shown in FIG. 4 has a central hollow part forming a main chamber 14 which is defined by the inner side wall 15 and outer side wall 16 of the hoop 3 and is surrounded above and below by two small separate chambers 17 provided within the top and bottom parts of a narrower section of the hoop, which has a trapezoidal cross-section, and separated from the main chamber by two internal partitions 18. By means of this hollow structure it is possible to achieve a high rigidity and strength with a small amount of material, even after folding of the hoop, and the two walls of the hoop, i.e. inner wall 15 and outer wall 16, as well as the internal partitions 18, have a thickness of about only 1 mm. More generally, they may have a thickness of the metal ranging between 0.5 and 2 millimeters only, suitable for achieving a satisfactory rigidity and performance.

According to the embodiment described, the manufacturing method of which will be illustrated below, the hoop 3 is obtained by curving a section formed by means of extrusion and the extruded metal hoop 3 therefore has the specific structural feature that its different chambers 14, 17 extend over its entire length.

As a result of this design it is possible to exploit more fully the presence of the chambers in order to provide more aesthetic fixing means on the hoop. In fact, a first nut 24 is arranged within the central chamber 14 towards the end of each side arm 11, this nut 24 cooperating with a screw 23 positioned on the inner side of the binding and passing in succession, respectively, through the inner wall of the vertical side part 2 of the base and the inner wall 15 of the hoop 3 through an opening 13, the width of which corresponds to the diameter of the screw 23. This opening 13 extends longitudinally on the inner wall 15 of the hoop, thus forming an aperture, so as to allow substantially longitudinal adjustment of the position of the hoop 3 relative to the base 2. In fact, in order to perform such an adjustment, it is sufficient to loosen the screw 23 in order to allow movement of the hoop 3 within its seat inside the base 2, the nut 24 thus being displaced within the chamber 14 inside which it is situated. This displacement is possible over the entire length of the opening 13 which thus allows one to define easily the desired adjustment range. By means of this displacement it is therefore possible to move forwards or backwards the rounded part 12 of the hoop which supports the heel of the boot and adapt the binding to different boot sizes.

Advantageously, a stop is provided within the chamber 14 so as to limit the displacement of the nut 24 over a length substantially equivalent to that of the aperture and prevent loss of the nut 24, either within the chamber 14 or outside the hoop 3. Such a stop could for example be obtained by means of narrowing of the chamber 14 achieved by means of light punching of the inner wall 15 of the hoop on either side of the opening 13. In this embodiment shown, the stops are obtained by means of an insert 27 which is positioned within the central chamber 14, which will be described in detail further below. Moreover, owing to the trapezoidal form of the chamber 14, it is possible to hold in a controlled manner the nut 24, with a matching trapezoidal shape, inside it, said nut remaining locked in position and being unable to slide inside the chamber 14 in the tightened configuration owing to cooperation between the inclined sloping surfaces of the nut and the chamber.

A second similar fixing system on the hoop is provided further back on each arm 11, by means of a second nut 26 which is positioned inside the same main central chamber 14 and can be accessed for screwing via an opening 19 provided on the inner wall 15 of the hoop opposite this nut 26 and having a size corresponding to that of the screw 25 cooperating with the nut 26. With this arrangement it is possible to perform fixing of a boot holding device, based for example on a fixing strap 6 intended to cover the top of the boot opposite the heel and a highback 4. By way of a variant, the opening 19 could be an aperture offering the possibility of adjustment of these parts in a manner similar to that of the front opening 13.

In both cases, the fixing systems thus provided on the hoop result in limited visibility of the fixing means compared to the state of the art since only the heads of the screws 23, 25 are visible only on the inner side of the binding, namely the side directed towards the horizontal base 1, this side being hidden by the boot during use of the device. It is thus possible to achieve a markedly improved aesthetic appearance since no fixing means is visible from outside the binding in the region of the hoop.

According to this embodiment, in order to facilitate positioning of the nuts 24, 26 and keep them in contact with the stops, an insert 27 is inserted inside the main chamber 14 via the end of each arm 11 of the hoop. This insert defines two seats 28, 29 for each nut 24, 26, stops 30, 31, 32, 33 on each side of each seat 28, 29 in order to delimit the longitudinal displacement of the nuts 24, 26 and an end face 34 which remains outside the hoop 3 and allows the ends of the two arms 11 of the hoop to be fixed and arranged in position. By means of this insert 27 it is thus possible to ensure correct positioning of the first nut 24 within its displacement range corresponding to the aperture and correct positioning of the second nut 26 opposite the opening 19. Such an insert performs moreover a sealing function for the hoop and may even improve the binding by cooperating with the screws 23, 25 so that the nuts 24, 26 act as Nylstop nuts.

The invention also relates to the manufacturing method which consists in a stage for manufacturing a section with a trapezoidal cross-section comprising three chambers 14, 17, by means of extrusion, followed by cutting and forming, by means of curving or folding, for example, this section so as to obtain the final geometry described above and shown in the figures. Finally, openings 13, 19 are formed by means of machining and the inserts 27, 24, 26 are positioned within the hoop. Such a method has the advantage that it is low-cost since it uses a small quantity of metal per section and produces moreover little or no waste material.

However, advantageous hoops which are based on the idea of the invention may be manufactured by other methods using other materials. For example, hoops made of plastic comprising at least a few hollow parts may be obtained by means of extrusion. By way of a variant, such plastic hoops could be obtained by means of injection-molding or profiling. These hoops may also be manufactured using other materials such as carbon, kevlar or glass fibers embedded in a thermosetting or thermoplastic matrix. For this purpose, a fabric composed of these fibers may be formed around a mandrel or by any other equivalent known method.

The combination of a hoop which is separate from the base and at least partially hollow has the advantage that it offers a multitude of possibilities in terms of the geometry and appearance of the hoop. In fact, owing to these combined separate and hollow characteristics of the hoop, it is possible to overcome on the one hand the constraints imposed by the base manufacturing process and on the other hand the mechanical constraints relating to rigidity since the hollow parts achieve a satisfactory rigidity fairly easily. With this solution it is therefore possible to choose relatively freely the form of the hoop cross-section and seek effective variations in terms of aesthetics. Moreover, owing to the presence of the chambers, it is also possible to achieve an improvement in the aesthetic appearance of the hoop while concealing at least partially the different fixing means which are provided on the hoop.

The hoop shown has a constant cross-section and chambers extending over its entire length as a result of the extrusion method used. However, its cross-section could vary and the hoop could have solely a few hollow parts, with a single or several chambers, without thereby departing from the idea of the invention, since these hollow parts are sufficient to reinforce mechanically the overall structure of the hoop and/or position the aesthetic fixing means described above.

The middle part 12 of the hoop, which is situated between the two arms 11, could have a form other than a rounded form. For example, in order to obtain a technical effect resulting in an increase in the rigidity of this intermediate central part, the latter could be in the form of several broken lines I which are obtained, for example, by means of several folds of a section.

Moreover, the hollow structure of the hoop has been shown with chambers which are completely closed, except for the openings 13, 19 provided for the fixing functions. However, other openings may be added to the inner wall 15 and/or outer wall 16 and/or top and/or bottom wall of the hoop, for example in order to lighten the hoop and reduce the amount of material used or simply in order to provide a decorative effect. However, the presence of zones comprising at least one closed chamber has the advantage that a good rigidity may be achieved in exchange for a small amount of material used.

The hoop may consist of different rigid materials, metal or plastic. With these materials new decorative effects are possible for the hoops. For example they may be made of aluminum and decorated using anodization, sandblasting or tampography techniques. By way of a variant, they may comprise parts made of plastic transparent materials which allow transparent viewing of decorative elements which are positioned inside an inner hollow part or on its inner surface.

Finally, the hoop is a part which is separate from the base and is connected to the base by means of an adjustable nut screw device. Any other means could be used as a variant, such as positioning the head of the screw inside a chamber of the hoop and the nut on the outside, or any means other than a screw/nut combination, such as a solution based on a cam connection which can be operated without a tool.

Finally, with the solution according to the invention it is possible to achieve the objects of the invention and provide the following advantages:

- the position of the hoop may be adjustable in relation to the base and the boot binding may be adapted in the best possible manner to different boot sizes;
- the hoop requires overall less material in order to obtain an at least equivalent mechanical rigidity, resulting in a gain from a cost point of view;
- with this hoop an improvement in the aesthetic appearance thereof is possible, in terms of both its fixing points and its overall form.

What is claimed:

1. A rear hoop for a snowboard boot binding, having an overall shape in the form of a U and comprising a central connecting part arranged between two arms, the two arms suitable for forming a movable connection with a snowboard boot binding, wherein the rear hoop comprises at least one zone where the rear hoop consists of an extruded hollow body and at least one zone with at least one chamber on each of the two arms, and wherein the two arms have inner side walls, said inner side walls comprising an opening providing access to a connecting means to allow connection of the rear hoop to a part of a snowboard boot binding.

2. The rear hoop as claimed in claim 1, wherein the rear hoop has at least a chamber over its entire length.

3. The rear hoop as claimed in claim 1, wherein the rear hoop comprises at least one zone with at least one closed chamber.

4. The rear hoop as claimed in claim 1, comprising at least one connecting means for a part of the snowboard boot binding positioned within a chamber of the structure in a movable manner within this chamber to allow adjustment of the binding, and an aperture corresponding to the connecting means in its inner wall.

5. The rear hoop as claimed in claim 1, comprising a nut inserted inside the chamber of the rear hoop.

6. The rear hoop as claimed in claim 1, wherein an outer wall of the rear hoop conceals the connecting means, which is inserted inside the chamber.

7. The rear hoop as claimed in claim 1, wherein the central connecting part of the rear hoop has a curved rounded shape or a shape in the form of folded broken lines.

8. A snowboard boot binding, comprising a rear hoop as claimed in claim 1.

9. A snowboard, comprising a boot binding comprising a rear hoop as claimed in claim 1.

10. The rear hoop as claimed in claim 1, wherein the rear hoop is rigid.

11. The rear hoop as claimed in claim 1, wherein the inner wall of the rear hoop comprises an opening providing access to the connecting means to allow connection of a fixing strap intended to cover the top of a boot opposite the heel and a highback.

12. The rear hoop as claimed in claim 2, wherein the rear hoop has several chambers which are substantially parallel.

13. The rear hoop as claimed in claim 2, wherein the rear hoop is made of metal or extruded plastic.

14. The rear hoop as claimed in claim 4, wherein the chamber comprising the connecting means has a substantially trapezoidal cross-section in order to improve holding of the connecting means within the rear hoop.

15. The snowboard boot binding as claimed in claim 8, wherein the rear hoop is separate from a base of the snowboard boot binding, is movable and is fixable in an adjustable manner longitudinally in relation to the base.

16. The snowboard boot binding as claimed in claim 8, wherein the rear hoop is separate from a base and movably connected to the base by the two arms, the two arms being parallel and which cooperate with seats formed in side parts of the base.

17. The snowboard boot binding as claimed in claim 15, wherein the rear hoop is mounted movably longitudinally in a seat formed in each side part of the binding, by a first connecting means mounted movable within a chamber of the rear hoop and cooperating with a second connecting means passing in succession through an inner wall of the side part and the inner wall of the rear hoop, the rear hoop including a longitudinal aperture defining the travel for adjusting the position of the rear hoop.

18. A snowboard boot binding, comprising a base having a horizontal part intended to receive a boot between vertical side parts intended to laterally hold the boot, and comprising a rear hoop having an overall shape in the form of a U and comprising a central connecting part arranged between two arms, wherein the rear hoop comprises at least one zone where the rear hoop includes an extruded hollow body and at least one zone with at least one chamber on each of the two arms, and wherein the two arms of the rear hoop are mounted movable in translation within the vertical side parts of the base so as to allow substantially longitudinal adjustment of the position of the rear hoop relative to the base.

19. The snowboard boot binding as claimed in claim 18, wherein the two arms of the rear hoop have inner side walls, each of said inner side walls comprising an opening extending longitudinally, thus forming an aperture, so as to allow substantially longitudinal adjustment of the position of the rear hoop relative to the base.

20. The snowboard boot binding as claimed in claim 19, wherein the displacement of the rear hoop relative to the base is enabled over the entire length of the openings of the inner side walls of the rear hoop that allow to define a desired adjustment range, inducing the forwards or backwards movement of the central connecting part of the rear hoop that supports the heel of the boot.

* * * * *